US010738422B2

(12) United States Patent
Annan et al.

(10) Patent No.: US 10,738,422 B2
(45) Date of Patent: Aug. 11, 2020

(54) CABLE ANCHORAGE WITH SEAL ELEMENT, PRESTRESSING SYSTEM COMPRISING SUCH ANCHORAGE AND METHOD FOR INSTALLING AND TENSIONING A SHEATHED ELONGATED ELEMENT

(71) Applicant: VSL International AG, Bern (CH)

(72) Inventors: Rachid Annan, Rapperswil (CH); Adrian Gnägi, Bern (CH); Javier Martinez Moral, Sant Cugat del Valles (ES)

(73) Assignee: VSL International AG, Bern (CH)

( * ) Notice: Subject to any disclaimer, the term of this patent is extended or adjusted under 35 U.S.C. 154(b) by 0 days.

(21) Appl. No.: 16/325,625

(22) PCT Filed: Aug. 16, 2017

(86) PCT No.: PCT/IB2017/054975
§ 371 (c)(1),
(2) Date: Feb. 14, 2019

(87) PCT Pub. No.: WO2018/033865
PCT Pub. Date: Feb. 22, 2018

(65) Prior Publication Data

US 2019/0194884 A1 Jun. 27, 2019

(30) Foreign Application Priority Data

Aug. 19, 2016 (EP) ..... 16185017

(51) Int. Cl.
*E01D 19/14* (2006.01)
*E01D 19/16* (2006.01)
(Continued)

(52) U.S. Cl.
CPC ..... *E01D 19/14* (2013.01); *E01D 19/16* (2013.01); *E01D 21/00* (2013.01); *E04B 1/22* (2013.01);
(Continued)

(58) Field of Classification Search
CPC ..... E01D 19/14; E01D 19/16; E01D 21/00; E01D 2101/28; E01D 2101/32;
(Continued)

(56) References Cited

U.S. PATENT DOCUMENTS 4,363,462 A * 12/1982 Wlodkowski ..... E04C 5/12 24/115 M
4,633,540 A * 1/1987 Jungwirth ..... E04C 5/122 14/21
(Continued)

FOREIGN PATENT DOCUMENTS

WO WO-2014/191568 A1 12/2014

OTHER PUBLICATIONS

International Search Report and Written Opinion for PCT/IB2017/054975, dated Dec. 6, 2017, 5 pages.

*Primary Examiner* — Brian D Mattei
(74) *Attorney, Agent, or Firm* — Blank Rome LLP

(57) ABSTRACT

The present invention concerns a cable anchorage comprising at least one axial channel for accommodating an elongated element with a sheathed portion and an unsheathed end portion, wherein the channel between a first channel end, proximal to a running part of the elongated element, and a second channel end equipped with immobilising device, a seal element in the channel, a stop element having an end facing said seal element which defines a shoulder, so that an axial displacement of the of the elongated element with respect to the stop element in said channel is possible up to the abutment of the end of the sheathed portion against the
(Continued)

shoulder, creating thereby an abutment position of the elongated element in said channel.

14 Claims, 5 Drawing Sheets

(51) Int. Cl.
*E04B 1/22* (2006.01)
*E04C 5/12* (2006.01)
*E01D 21/00* (2006.01)
*E01D 101/28* (2006.01)
*E01D 101/32* (2006.01)

(52) U.S. Cl.
CPC ..... *E04C 5/122* (2013.01); *E01D 2101/28* (2013.01); *E01D 2101/32* (2013.01)

(58) Field of Classification Search
CPC . E04C 5/12; E04C 5/122; E04C 5/127; E02D 5/808; E02D 2600/30; Y10T 24/3909; E04B 1/22
See application file for complete search history.

(56) References Cited

U.S. PATENT DOCUMENTS 5,788,398 A * 8/1998 Sorkin ..... E04C 5/12 285/138.1
6,560,807 B1 * 5/2003 Stubler ..... D07B 1/068 14/22
6,578,329 B1 * 6/2003 Stubler ..... E01D 19/14 24/122.6
7,856,774 B1 12/2010 Sorkin
8,065,845 B1 11/2011 Sorkin
2002/0086158 A1 * 7/2002 Stubler ..... D07B 7/145 428/375
2002/0108329 A1 * 8/2002 Bournand ..... E01D 19/14 52/223.13
2005/0169702 A1 * 8/2005 Paulshus ..... B63B 21/502 403/300
2012/0058338 A1 * 3/2012 Fyfe ..... D07B 1/00 428/365
2013/0174530 A1 * 7/2013 Mellier ..... D07B 5/00 57/232

* cited by examiner

CABLE ANCHORAGE WITH SEAL ELEMENT, PRESTRESSING SYSTEM COMPRISING SUCH ANCHORAGE AND METHOD FOR INSTALLING AND TENSIONING A SHEATHED ELONGATED ELEMENT

RELATED APPLICATIONS

This application is a national phase of PCT/IB2017/054975, filed on Aug. 16, 2017 which claims priority to European Patent Application No. 16185017.7, filed on Aug. 19, 2016. The entire contents of these applications are hereby incorporated by reference.

FIELD OF THE INVENTION

The present invention concerns the field of cable anchorages, such as may be used, for example, for anchoring longitudinal structural elements which are designed to be tensioned, such as wires, ropes, strands, tendons, stays or cables. In particular, but not exclusively, the invention relates to individual sealing arrangements for individual cable strands in such anchorages.

DESCRIPTION OF RELATED ART

In order to illustrate the advantages of the invention, reference will be made to the application prestressing using of (external) post-tensioning (or PT) cables. However, it should be understood that this application is not limiting, and that the principles underlying the invention may be applied to any kind of tensioned cables or similar elements such as wires, ropes, strands and tendons which are used to carry tensile forces in bridges, buildings, roofs, masts, towers or similar structures.

As possible application of the anchorage according to the invention, the elongated element is an external post-tensioning (or PT) cable, which is typically used for bridge girders, slabs and beams for buildings and parking structures. Each cable is generally formed by a monostrand tendon consisting of a seven-wire strand that is coated with a corrosion-inhibiting grease or wax and encased in an extruded plastic protective sheathing.

Also, the anchorage according to the invention could be used for stay cables which are used notably for supporting bridge decks, for example, and may typically be held in tension between an upper anchorage, secured to a tower of the bridge, and a lower anchorage, secured to the bridge deck.

A cable may comprise dozens or scores of strands, with each strand comprising multiple (e.g. 7) steel wires. Each strand is usually retained individually in each anchorage, which may immobilize the strand using a tapered conical wedge seated in a conical hole in an anchor block, for example. Tensioning of the strands may be performed, from either one of the cable ends, using hydraulic jacks. The condition of the individual strands is typically monitored regularly to detect any corrosion or mechanical deterioration. If such deterioration is found in a particular strand, it may be de-tensioned, removed from the cable, replaced with a new strand and the new strand tensioned. If such a replacement operation is performed, great care must be taken to ensure that the new strand is sealed again against ingress of moisture.

Another non limiting application of external post-tensioned systems (PT systems) using tensioned cables concerns concrete wind towers in which the tensioned stay cables are vertical or slightly inclined. In that case, the cable is installed once the structure is concreted, and allows a transfer of the vertical prestressing force to the foundation of the tower at the lowest end of the tendon.

It has been proposed in patent application WO2014191568, from the same applicant, to provide individual sealing arrangements for each strand, so that an individual strand and corresponding individual seal element can be replaced and re-sealed without affecting the seals of the other strands. The proposed anchorage uses individual seal elements, each held in place in a recessed region of the channel accommodating the strand. This recessed region guarantees that the seal element stays in the right location along the strand channel. When replacing a strand through this anchorage, care must be taken, when removing the old strand and inserting the new strand, to place the new strand such that the new strand is surrounded by the seal element on its sheathed portion and not on its unsheathed portion. After tensioning, the exposed end of the cable may be protected by injecting grease or wax or gel into the cavity surrounding the unsheathed portion of the strand inside the anchorage. In such prior art the strand cannot be replaced easily without precisely beforehand removing a sheath portion along a quite precise length of the new strand, which implies specific steps during mounting and post-installation controls. Also, such a cable anchorage requires an anchorage length which is sufficient so as to after locking the strand end in the anchorage, the sheathed portion of the strand is protruding beyond the seal element at the end of the stressing operation and during the whole further lifetime of the strand even when considering all installation tolerances, thermal effects and creep. While the use of adherent protected and sheathed strand according to Standard XP A35-037-1 clause 3.2.2 (type SC) allows to control the residual movement between the wires and the sheath due to thermal effects or creep despite the difference of thermal expansion coefficient between the steel wires of the strand and the plastic sheath of the strand, when considering the typical operating thermal range, namely around −20° C. up to +40° C., a significant allowance still has to be made for tolerances in cable length during installation. In some arrangement, the required minimum length makes the anchorages larger and heavier than what can be easily accommodated in the structure and renders the installation process more difficult.

U.S. Pat. No. 8,065,845 concerns another anchorage structure with a pair of wedges which is engaged with the unsheathed portion of a tendon whereas a sheathing lock is positioned adjacent the pair of wedges, around the sheathing. Some locking ribs extending inwardly radially from the inner wall of the sheathing lock engage the sheathing for locking the tendon. A seal placed around the sheathed portion of the tendon closes in a liquid-tight manner the end (trumpet) of the cavity formed in the anchor member, and which contains the anchorage structure. This seal has a special shape with its first end accommodating the extremity of the sheathing lock and its second end extending radially inwardly for liquid-tight sealing. This arrangement does not provide a solution with a possible easy and safe installation or replacement of both the tendon and the seal.

It is an object of the present invention to overcome this and/or other disadvantages of prior art anchorages. Among other, it is an object of the invention to provide a cable anchorage easy to be assembled and/or installed, in order to obtain a safe positioning of the seal around the sheathed portion of the strand, and a safe sealing effect. In particular, the invention aims to provide an anchorage and a method in which the anchorage length can be shorten.

BRIEF SUMMARY OF THE INVENTION

According to the invention, these aims are achieved by means of a cable anchorage according to claim 1.

With such an arrangement, the end position of the sheath end during stressing, namely pulling of the strand within the channel, is known precisely by abutting the sheath end against the shoulder of the stop element. This provides a safe, rapid and reliable pulling operation, independently of the precise control of the length of the unsheathed portion of the strand during stripping and during mounting of the strand.

In the present text, a strand is a monostrand in the sense of a sheathed strand (the sheath being in general a plastic sheath, notably a PE sheath). More generally, the present invention relates to any elongated element comprising a core and a sheath. Preferably, said elongated element is a tendon comprising a strand placed in a sheath.

Preferably, the volume of the recessed region is made such that in said abutment position the sheath end of the sheathed portion is deformed so as to form an outwardly radially protrusion at least partially surrounded by the seal element which is thereby outwardly radially compressed by said deformed sheath end, whereby said deformed sheath end is mechanically anchored inside the recessed region in said axial channel.

Also, the stop element provides a rigid end at its shoulder location, on which abuts the sheath end, and on further pulling of the strand, allows a creasing of the end portion of the sheath. This deformation of the sheath end of the sheathed portion forms a bulging which enhances the seal properties. As a surprising effect, this outward bulging deformation of the end portion of the sheath creates a primary fixing or a locking function between the deformed end portion of the sheath and the recessed region of the anchorage through the combination of the highly compressed seal element and the highly compressed sheathing portion.

In addition, this locking function highly limits the thermal relative movement between the sheath end which is locked to the recessed region and the wires which are locked to the immobilising device. This situation permits to shorten the length of the anchorage with respect to prior art anchorages. In addition to a cost reduction, a short length of the anchorage allows to equip with such a cable anchorage some structures with reduced available space at the end of the cable.

In the method according to the invention for installing and tensioning a sheathed elongated element with a sheathed running portion, as defined in claim 15, a first unsheathed end portion and a second unsheathed end portion, said sheathed elongated element comprising a sheath with a first sheath end adjacent to said first unsheathed end portion and a second sheath end adjacent to said second unsheathed end portion, said method comprising the following steps:

- providing for at least the second unsheathed end portions an axial channel extending between a first channel end, proximal to said running part of the elongated element, and a second channel end, said axial channel being equipped with a seal element and with a stop element placed between said seal element and said second channel end,
- introducing, for at least the second unsheathed end portions, the extremity of said unsheathed end portion in said first channel end and axially displacing said extremity of said unsheathed end portion up to the second channel end,
- immobilising the extremity of said first unsheathed end portion with respect to a cable anchorage
- pulling the extremity of said second unsheathed end portion from the second channel end at least until the second sheath end of said sheath end portion abuts against a shoulder of said stop element in order to obtain a tensioned elongated element, and
- immobilising the extremity of said second unsheathed end portion of said tensioned elongated element with respect to said second channel end.

By abutting against the shoulder of said stop element, the second sheath end of said sheath end portion is automatically in the correct position. By pulling further the extremity of said second unsheathed end portion from the second channel end, one can create the locking function as described above and as will be described in further details hereinafter.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

Figure 1:
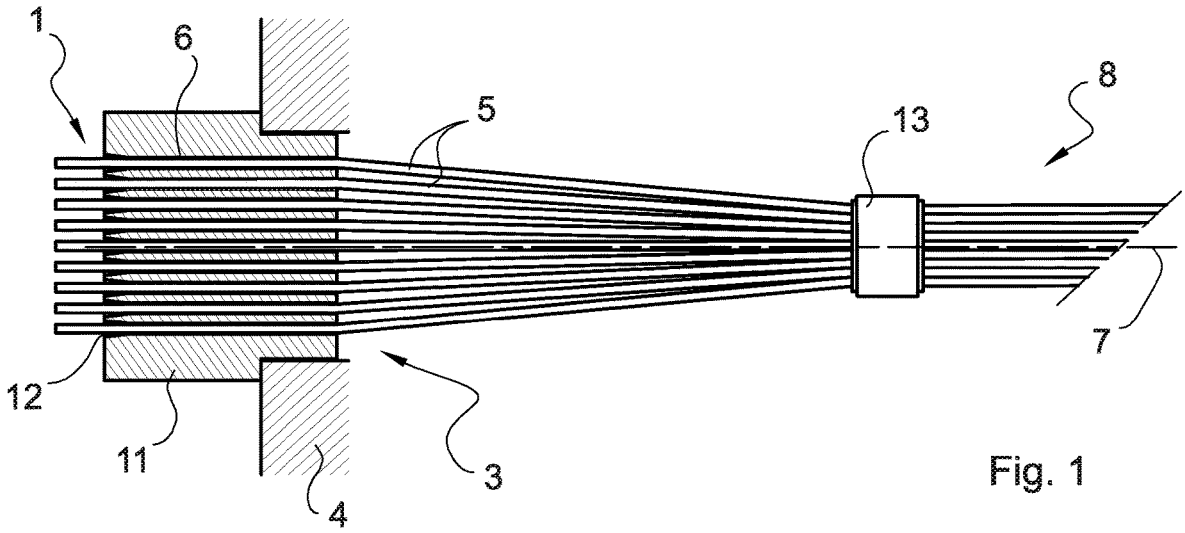
FIG. 1 shows in schematic cross-sectional view a cable anchored in a cable anchorage.

The figures are hereby provided for illustrative purposes only. They are intended as an aid to understanding certain principles underlying the invention, and they should not be taken as limiting the scope of protection sought. Where the same reference numerals are used in different figures, these are intended to refer to the same or corresponding features. However, the use of different numerals does not necessarily indicate any particular difference between the features to which they refer.

In the present text "inner diameter" and "outer diameter" are expressions relating to the radial dimensions of the corresponding element, "radial" direction being orthogonal to the axial or main direction. In case where this element has not a circular shape, the expressions "inner diameter" and "outer diameter" also apply and should be understood as the largest transverse dimensions of the corresponding element.

FIG. 1 shows a general schematic cross-sectional view of a cable anchorage in operation. Multiple strands 5 are threaded through axial channels 6 in an anchor block 11 and are held in place by an immobilising device, for example, conical wedges 12. The anchor block 11 is held in a structure 4 (part of a bridge deck or basement of a wind tower, for example) which is to be supported or tensioned by the cable. The various strands 5 of the cable are shown gathered together by a collar element 13, from where they proceed to the main running part 8 of the cable. Reference 7 indicates the principal longitudinal axis 7 of the cable and of the anchorage. Reference 3 indicates a first end as an exit end of the anchorage, proximal to the running part 8, while reference 1 indicates a second end of the anchorage, remote from the running part 8 of the cable. The channels 6 extend between said first channel end 3 and said second channel end 1. Preferably, the channels 6 extend along the whole length of the cable anchorage.

Figure 2:
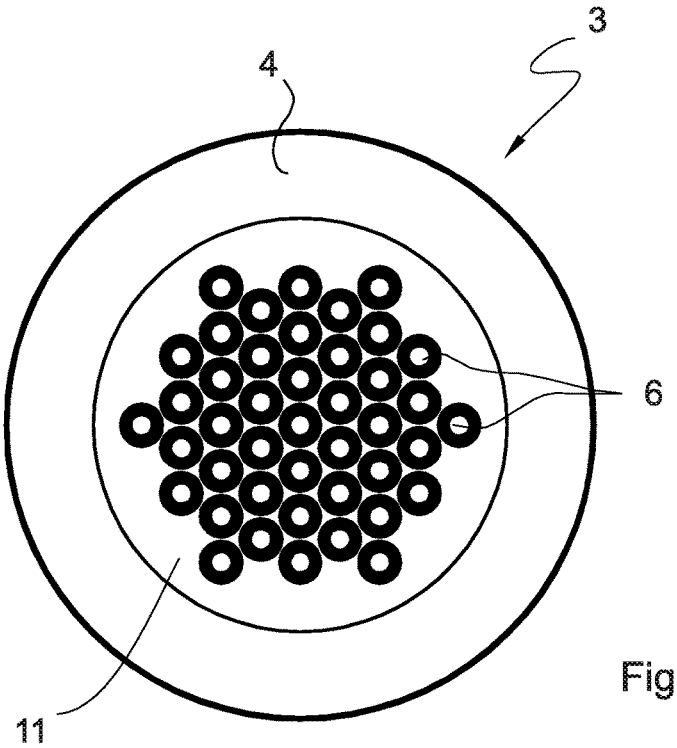
FIG. 2 shows in schematic form an example of a front-end view of a cable anchorage.

FIG. 2 shows a frontal view of an anchorage such as the one shown in FIG. 1, viewed from the proximal end 3, and omitting the strands 5. FIG. 2 illustrates in particular an example of an array arrangement of channels 6 through which the strands 5 pass when the anchorage is in operation. In FIG. 2, 43 strand channels 6 are illustrated, although other arrangements and numbers of channels 6 and strands 5 may be used. The strands 5 are accommodated in the cylindrical channels 6 which extend through the length of the anchorage, and are kept as close to each other as possible in the anchorage, so as to minimize the magnitude of any deviation of each strand 5 from the principal longitudinal axis 7 of the cable or the anchorage.

FIGS. 3 to 6 shows an example of a stressing end anchorage or active end anchorage equipped according to the present invention.

Figure 3:
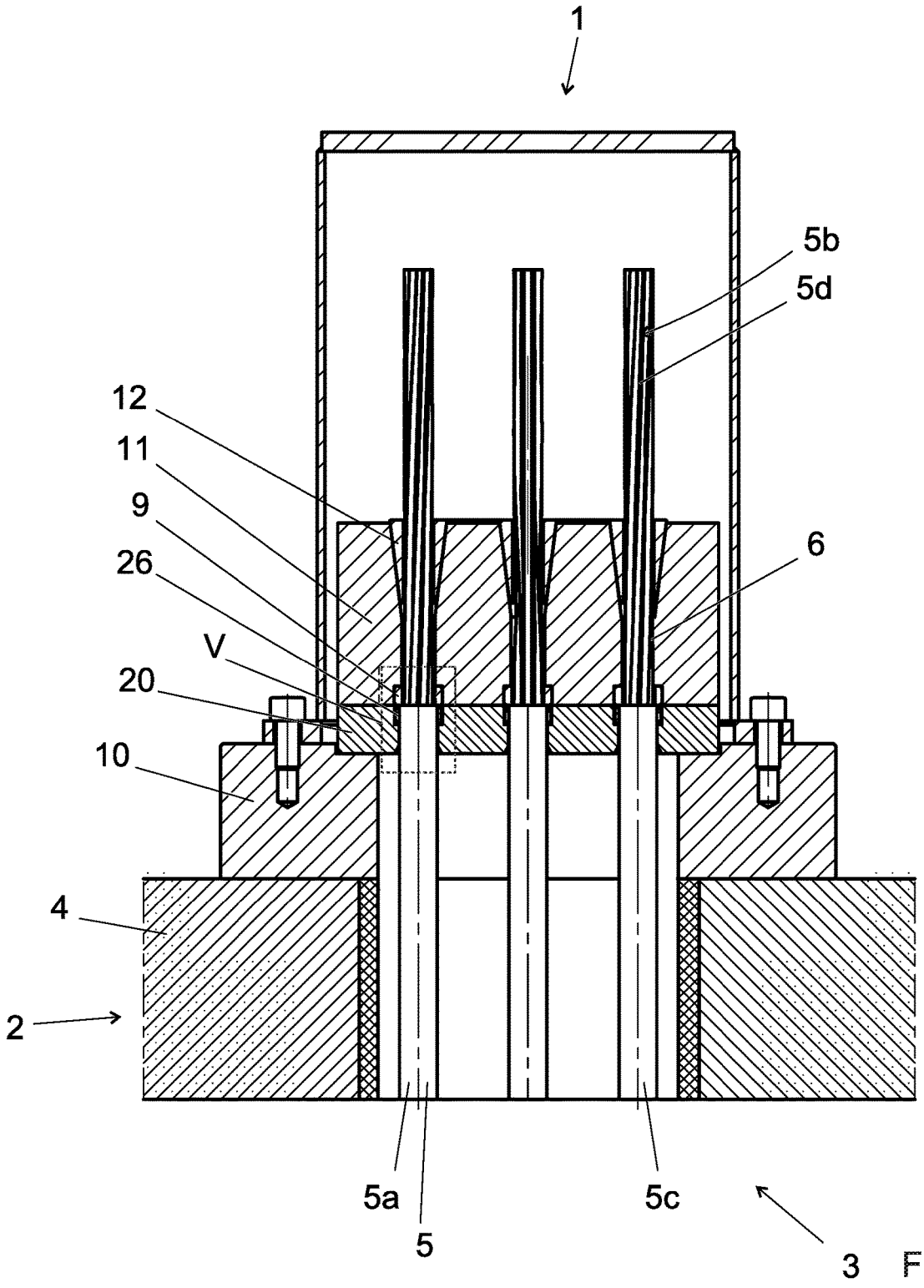
FIG. 3 shows a cross-sectional view of an example of an anchorage according to the invention, after a first stressing step.

The active end anchorage comprises channels 6 formed through an anchor block 11 (also named anchor head), which may for example be a block of hard steel or other material suitable for bearing the large axial tension forces in the cable. Strands 5 are held in place in the channels 6 by immobilising device such as conical wedges 12 in corresponding conical bores in the anchor block 11. FIG. 3 shows how the channels 6 extend through a stressing end of the anchorage, the stressing end being the end of the cable at which the strands of the cable are tensioned, namely the proximal end 1 of the anchorage.

A bearing plate or split shim 10 allows the anchorage to be positioned axially against a bearing surface of the structure 4, such as a bridge deck, which is to be supported and/or tensioned by the cable. Also, in one embodiment an end plate 20 is placed between the anchor block 11 and the bearing plate 10 in order to define easily the recessed region 27 as further described below. Also, in another embodiment, not shown, there is no end plate 20.

The end plate 20 can vary in thickness and may be fitted with an extension member such as a rigid transition pipe filled with a sufficiently stiff material (not shown) such as a concrete or grout or plastic material, except for the volume occupied by the channels 6 (and defined by the inner wall of the channel 6), which pass through the hard material. The channels 6 shown in the examples are substantially straight, and extend substantially parallel to each other and to the principal longitudinal direction of the cable, which is also referred to as the axial direction.

Stay cable strands 5 are typically sheathed in a protected polymeric material such as polyethylene (PE), which sheath 5*c* can be removed in the region of the strand where the strand is to be anchored (unsheathed portion 5*b*). In the FIGS. 3 to 5 the sheathed portions 5*a* of the strands 5 are distinguished from the stripped regions or unsheathed portions 5*b* by the absence of any cross-hatching or filling whereas unsheathed portions 5*a* are striped to show the nude wires 5*d*. D1 is the outer diameter of the sheathed portion 5*a* (sheathed strand 5) and D2 is the outer diameter of the unsheathed portion 5*b* (bare strand 5).

The strands 5 which are to be anchored in the anchorage are stripped of their polymer sheath 5*c* in the end region of the strand 5 before the strand 5 is inserted into the anchorage channels 6. This is so that the wedges 12 can then grip directly on to the bare steel of the unsheathed portions 5*a* of the strand 5, instead of the sheath 5*c*. Enough sheath 5*c* must be stripped from each strand 5 such that, once the strand 5 has been pulled through the channel 6 of the anchor block 11 and fully tensioned, the end of the sheath 5*c* is located correctly at a predetermined location between the embedment point (where the anchor wedges 12 grip the strands) and the bearing plate 10, so that the sheath 5*c* is surrounded by the seal element 26, as further explained below.

Figure 6:
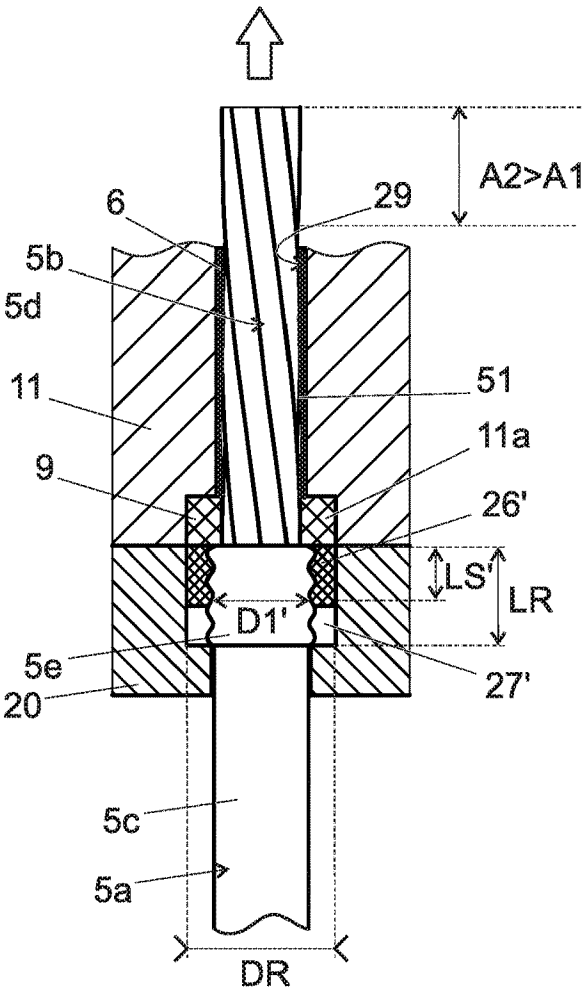
FIG. 6 shows an enlarged portion of the sectional view of part V of FIG. 3 after a second stressing step.
Figure 5:
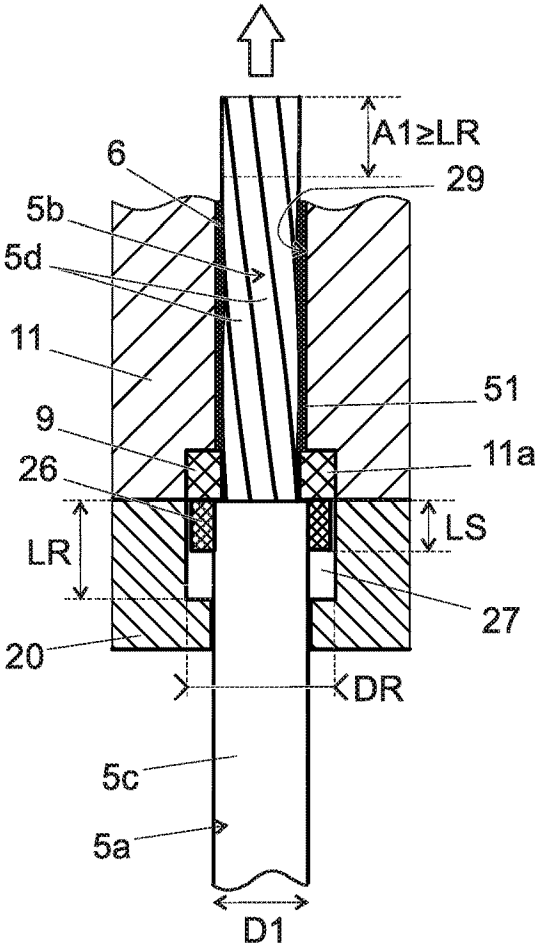
FIG. 5 shows an enlarged portion of the sectional view of part V of FIG. 3, namely after a first stressing step.
Figure 4:
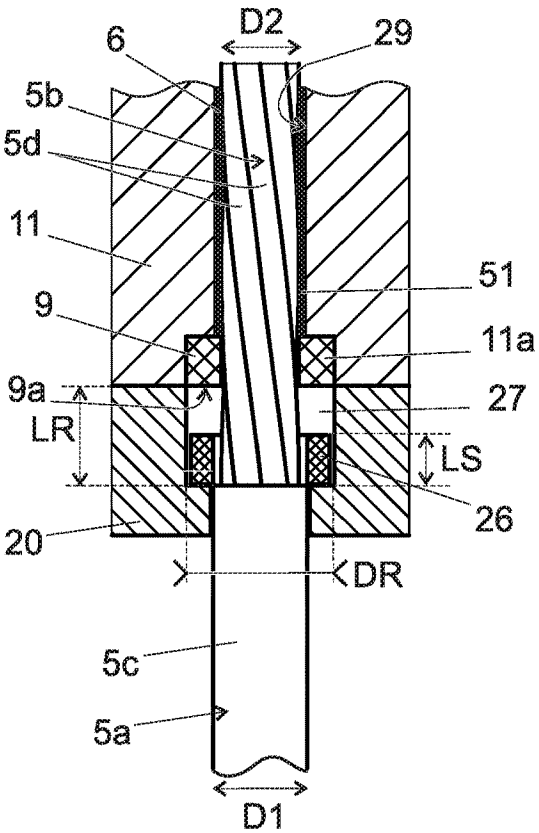
FIG. 4 shows an enlarged portion of the sectional view of part V of FIG. 3 before stressing.
Figure 8:
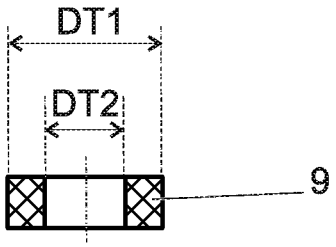
FIG. 8 shows a cross-sectional view of an example of a stop element for use in the invention.

As can be seen more clearly in FIGS. 4 to 6, the anchor block 11 defines an enlarged portion 11*a* of each of its holes forming a portion of the channel 6: this enlarged portion 11*a* of the hole forms a recessed region at the face of the anchor block 11 turning towards and in contact with said end plate 20. In that enlarged portion 11*a*, is inserted a stop element 9 formed by a rigid bushing. As shown in FIG. 8, this rigid bushing 9 is an annular part with an outer diameter DT1 and an inner diameter DT2. In other words, said stop element 9 is preferably formed by a bushing placed within said channel 6 and said shoulder 9*a* is formed between the end face of the bushing facing said seal element 26 and the channel 6. This bushing is preferably a rigid bushing such as a rigid plastic, for instance polypropylene (PP), Acrylonitrile butadiene styrene (ABS), Polyoxymethylene (POM).

Figure 9:
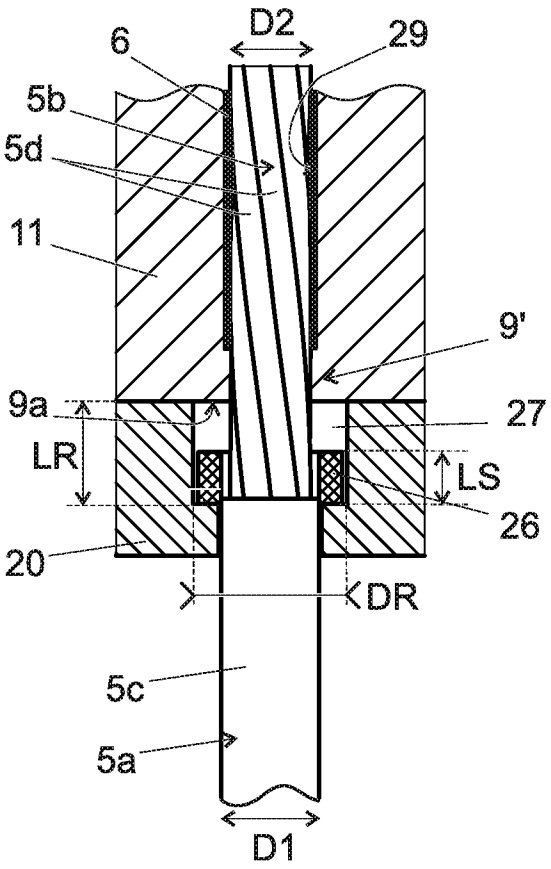
FIG. 9 shows a view as in FIG. 4 for an alternative embodiment.

As alternative to the use of a stop element 9 formed by a bushing, namely a part separate from the anchor block 11, another variant shown in FIG. 9 lies in a reduced diameter of the end portion 9' of the hole or channel 6 in the anchor block 11, forming a portion of the channel 6. In that situation, with such a local narrowing of the channel 6, there is no stop element formed by a part separate from the anchor block 11: here, the narrowing of the channel 6 (which is located in FIG. 9 at the side of the anchor block 11 facing the seal element 26) forms by itself the stop element 9.

Figure 10:
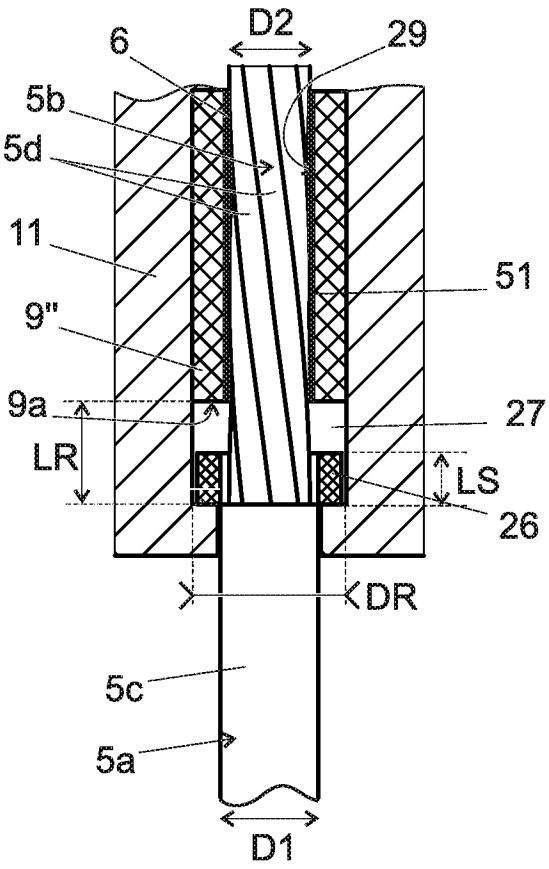
FIG. 10 shows a view as in FIG. 4 for another alternative embodiment.

As shown in FIG. 10, another possible alternative to the use of a stop element 9 formed by a bushing, said stop element 9 is formed by a tube 9", which is also a part separate from the anchor block 11, placed within said channel 6, said tube 9" extending up to the immobilising device (conical wedges 12). In that situation, said shoulder 9*a* is formed between the end face of the tube 9" facing said seal element 26 and the channel 6.

In all these cases, the stop element 9 defines a shoulder 9*a* facing the recessed region 27. This shoulder 9*a* forms a stop for holding back the sheath 5*c* and is formed at the front side of the bushing 9 (or at the narrowing of the channel 6 or at the front side of the tube 9"). As will be detailed further in relation with FIG. 4 to 6, once the strand 5 has been pulled through the channel 6 of the anchor block 11 and fully tensioned, the end of the sheath 5*c* is located against the shoulder 9*a*, namely between the stop element 9 and the seal element 26.

Also, the stop element 9 has an inner diameter DT2 which is smaller than the outer diameter DS1 of the seal element 26 in its uncompressed state so that the sealing element 26 cannot be pushed into the stop element 9. The seal element 26 and the stop element 9 can be chosen with the inner diameter DS2 of the seal element 26 smaller than the inner diameter DT2 of the stop element 9, but in any case the inner diameter DS2 of the seal element 26 and the inner diameter of the stop element 9 are both larger than the outer diameter D2 of the unsheathed portion 5*b* (bare strand 5). Since the outer shape of the section of strand is not perfectly circular, D2 is defined as the circular envelope of the wire pattern, namely of the bare strand.

Also, as can be seen more clearly in FIGS. 4, 5 and 6, the end plate 20 defines an annular or cylindrical recessed region 27, longitudinally coaxial with the channel 6, for accommodating and retaining the seal element 26. In this configuration, this seal element 26 prevents moisture from entering the anchorage from the proximal (first) end 3 of the anchorage and prevents any filler introduced into the channel 6 from the remote end 1 of the anchorage to leak out of the anchorage.

Figure 7:
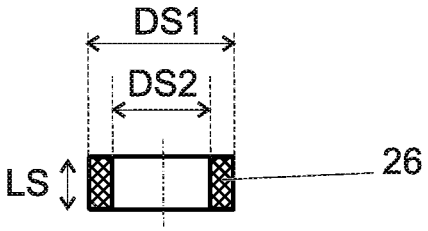
FIG. 7 shows a cross-sectional view of an example of a sealing element for use in the invention.

As shown in FIG. 7, this seal element 26 is an annular part with an outer diameter DS1, an inner diameter DS2 and a length LS in its uncompressed state. Preferably, the outer diameter DR of said recessed region 27 receiving said seal element 26 is smaller or sensitively equal to the outer diameter DT1 of the bushing 9. The length, namely the extension in axial direction, of said recessed region 27 is LR.

Preferably, the volume of said recessed region 27 that contains the seal element 26 is less than or equal to 3-times the volume of the displaced sheath 5*c* during said axial displacement of said elongated element 5 up to said abutment position plus the volume of said un-compressed seal element 26. Namely, the following equation applies:

$$\Pi/4\times(LR)\times((DR)^2-(D2)^2)\leq 3\times(\Pi/4\times(A1\times((D1)^2-(D2)^2)+LS\times((DS1)^2-(DS2)^2)).$$

Also, preferably, the volume of said recessed region 27 that contains the seal element 26 is less than or equal to 1.5-times the volume of the displaced sheath 5*c* during said axial displacement of said elongated element 5 up to said abutment position plus the volume of said un-compressed seal element 26. Namely, the following equation applies:

$$\Pi/4\times(LR)\times((DR)^2-(D2)^2)\leq 1.5\times(\Pi/4\times(A1\times((D1)^2-(D2)^2)+LS\times((DS1)^2-(DS2)^2)).$$

As visible on FIGS. 4, 5 and 6, said recessed region 27 receiving said seal element 26 and said region 11*a* receiving said stop element 9 are longitudinally adjacent to each other in the channel 6 so that, during axial displacement of said elongated element 5 in the channel 6 towards the remote end 1 of the anchorage (see the large arrow at the upper part of FIGS. 5 and 6), said seal element 26 can be placed in a longitudinal location adjoining said stop element 9. This longitudinal location of the seal element 26 as shown in FIGS. 5 and 6, with the seal element 26 abutting the shoulder 9*a*, corresponds to a predetermined axial location of the seal, which can be easily obtained through the arrangement of the cable anchorage according to the invention. Preferably, said seal element 26 is coaxial to said shoulder 9*a*.

Also, preferably, the volume of said recessed region 27 is made such that in an abutment position of the sheath against the shoulder 9*a* (see FIG. 6), the end of the sheathed portion 5*a* is deformed so as to form an outwardly radially protrusion 5*e* at least partially surrounded by the seal element 26 which is thereby outwardly radially compressed by said deformed sheath end 5*e*, whereby said deformed sheath end 5*e* is mechanically anchored inside the recessed region 27 in said axial channel 6. In other words, the seal element 26 is arranged immediately in front of the bushing 9: the end position of the sheath 5 is defined by its abutment against the bushing 9.

In a variant shown in FIG. 10, there is no end plate 20: in that situation, the anchor block 11 extends further axially in direction to the first end 3 of the anchorage (the bottom portion of FIG. 10) and defines the recessed region 27. This variant is also applicable to the embodiment of FIGS. 4 to 6 i.e the anchor block 11 forms a single piece part with the end plate 20 shown in FIGS. 4-6 and 9. When this variant without end plate 20 is applied to the to the embodiment of FIG. 4-6, it means that the enlarged portion 11*a* of the hole is forming a recessed region in the anchor block (end portion of the channel 6) that receives also the seal element 26, in addition to the stop element 9.

In a variant, not shown, the embodiment of FIG. 10 with the tube 9" also contains an end plate forming a separate piece from the anchor block 11, which end plate that would correspond to the bottom portion of the anchor block 11 of FIG. 10, starting from the axial position of the shoulder 9*a*.

Preferably, said tendon comprises a bare strand placed in a sheath 5*c*.

Preferably, said sheath 5*c* is adhering to the outer surface of the bare strand such as to limit the relative movement between said sheath 5*c* and bare strand under thermal effects in the typical service temperature range of −20° C. to +40° C. to less than L/2000 with L being the length of the sheathed strand portion (5*a*). For instance, said sheath 5*c* adheres by geometrical interlocking to the profiled outer surfaces of the bare strand. In other words, this means that there is an adherence of the sheath 5*c* with the strand that precludes their relative movement until a specified minimum force, as further explained in 7.5.3.4 of Standard XP A35-037-3:2003.

Preferably, the sheath 5*c* has a minimum friction resistance against sliding on the strand 5 of 1000N when determined on a 300 mm long sheathing sample in accordance with Standard XP A35-037-1 clause D3 (type SC).

These three definitions correspond to a type of sheathed strand which is named an adherent protected and sheathed strand 5, and can also be defined as "tightly extruded monostrand". Such a type of sheathed strand is obtained for instance by extrusion of the sheath directly around the bare strand, With such a type of sheathed strand, there is no movement, more precisely no free movement between the bare strand and the sheath 5*c*, which movement due to the difference of thermal dilatation coefficients of the bare strand and the sheath 5*c* would be for instance around 18/2000, namely 18 mm for a 2000° mm length of the sheathed strand portion based on a thermal coefficient of PE sheath of $15.10^{-5}$ per degree ° C.

As shown on FIGS. 4 to 6, with such an arrangement, when the strand free end is pulled from the remote end 1 of the cable, the sheath end enter into the seal element 26 and afterwards abuts the shoulder 9*a* in a first step visible in FIG. 5 corresponding to a first pulling length A1 of the cable which is equal to or larger than the length of the recessed region 27 LR. This first pulling length A1 also corresponds to the initial distance (see FIG. 4) between the sheath end and the shoulder 9*a*. Therefore, the situation of FIG. 5 shows an abutment position of the strand 5 in the channel 6 with no deformation nor bulging of the end of the sheath 5*c*.

Then, during a second step of the pulling operation, in which the total pulling length is A2 (see FIG. 6) the sheath 5*c* creases around the wires 5*d* so as to form a deformed sheath end 5*e* with an outwardly radially protrusion having a mean outer diameter D1'. In other words, said pulling step of the extremity of said second unsheathed end portion 5*b* is stopped after creasing of the second sheath end, whereby the extremity of said second sheath end is axially compressed against said shoulder 9*a*.

Also, preferably, said pulling step of the extremity of said second unsheathed end portion is stopped after creasing of the second sheath end, whereby the radial enlargement of the second sheath end creates an outward radial extension 5*e* of the seal element 26 and an inward radial pressure of the inner wall 29 of the channel 6 on the seal element 26 at the location of the recessed region 27.

This outwardly radially protrusion is compressed against the seal element, thereby forming a compressed seal element 26' as visible on FIG. 6. This compressed seal element 26' has an outer diameter DR, an inner diameter D1' (corresponding to the mean outer diameter D1' of the deformed sheath end 26') larger than the initial inner diameter DS2 and a length LS'. This situation permits an additional compression of the seal element 26 and hence enhances the sealing characteristics of the anchorage. Also, the sheath being bulged and compressed, this avoids any residual displacement of the sheath in the channel during temperature variation or due to material creep: this avoids having the sheath coming out of the sealing area even with a short anchorage.

The cable anchorage as described in the present text preferably applies, as shown in the drawings, for a prestressing system where it comprises a plurality of axial channels 6, each channel 6 for individually accommodating a strand 5 of a cable with a sheathed portion 5*a* and an unsheathed portion 5*b*, and for each axial channel 6 a seal element 26, an annular or cylindrical recessed region 27 for accommodating the seal element 26 and the stop element 9.

The stressing end anchorage is generally located at the more accessible end of the cable, where the strands can be pulled through the anchorage, for example by hydraulic jacks, until the strands are individually stressed to the required tension.

In order to ensure that the sheathed portion 5*a* protrudes inside the seal element 26 passage in the final configuration of the anchorage, it is sufficient to ensure that the initially unsheathed portion 5*b* is shorter than the distance between the shoulder 9*a* and the back face of the anchorage (second end 1), namely the free end of the anchor block 11, plus any required initial overlength of the strands left protruding from the free end of the anchor block 11 to allow gripping of the strand by the hydraulic jack. Any additional pulling of the strand 5 during stressing will result in creasing of the sheath 5*c* when abutting against the shoulder 9*a*.

With the anchorage arrangement according to the invention, a typical length for an active end anchorage is greatly reduced. For instance, typical lengths for prior art active end anchorages are ranged from 500 to 1000 mm from the seal element 26 to the second end 1 of the anchorage, namely the free end of the anchor block 11, whereas active end anchorages according to the invention have typical lengths ranging from 50 to 300 mm.

Once the sheathed strand 5 is fitted in the active end anchorage, it is important to protect the bare portion 5*b* of the strand 5 against the corrosive effects of atmospheric moisture. For this reason, the seal element 26 is fitted, under elastic compression, in a reduced space 27' between the inner surface of the channel 6 and the outer surface of the sheath 5*c* of the strand 5. This reduced space 27' corresponds to the annular portion of the recessed region 27 around the sheath 5*c*, having a reduced thickness, namely a reduced inner diameter, due to the larger radial extension of the deformed sheath end 5*e*.

A protective wax, grease, polymer or other protective substance forming a filler material may also be injected or otherwise introduced into the space 51 radially defined between the strand 5 and the wall of the channel 6, and axially defined from the free end of the anchor block 11 up to the stop element 9 (9' or 9") (namely as shown in the upper part of FIGS. 3, 4 to 6, 9 and 10). This filler material can be present along the whole axial extension of this space 51 or only along a limited portion along the axial extension of this space 51. Preferably, this filler material is present in this space 51 up to the stop element 9 (9' or 9"). With such a filler material, the seal element 26 may also serve as a barrier to the ingress of moisture into the cavity 51 while retaining the filler material within the cavity 51 (not shown).

Even if not shown, the cable anchorage according to the present invention also applies for a "passive end" anchorage, also known as a "dead end" anchorage. Such a passive end anchorage is used simply to hold the ends of the strands 5 when they are under tension, and also while they are being tensioned from the other end of the cable, namely the stressing end. Such a passive end anchorage of the prior art differs from the active end anchorage in that the anchorage can be significantly shorter than the active end anchorage because there is no need, as for the active end anchorage, to accommodate the axial movement of the strands and the related tolerances of the strands dimensions through the anchorage as the strands are tensioned. The strand is simply pushed into the anchorage until the sheathing abuts against the shoulder 9*a* of the stop element: this would correspond to the end of the first pulling step as shown in FIG. 5.

With an anchorage arranged according to the present invention, the length of the cable anchorage of an active end anchorage is reduced and lies in the same range as a passive end anchorage of the prior art.

In an embodiment, the anchorage according to the invention is used only for the passive end anchorage of a cable, and not for the active end anchorage of the same cable.

In another embodiment, the anchorage according to the invention is used only for the active end anchorage of a cable, and not for the passive end anchorage of the same cable In still another embodiment, the anchorage according to the invention is used for both ends of a cable, namely the passive end anchorage and the active end anchorage.

More generally, the invention concerns also a prestressing system comprising at least one tendon forming said elongated element 5, said tendon having an unsheathed portion 5*b* at its both ends, and two cable anchorages for the fixing under tension of the two end portions of said tendon, wherein at least one of said two cable anchorages is a cable anchorage according to the invention as described above. The other of said two cable anchorages can also be a cable anchorage according to the invention as described above or any other type of cable anchorage.

The present application also concerns a wind tower (i.e. the support mast of a wind turbine) comprising a bottom part and a top part, and, between said bottom part and said top part, at least one prestressing system as described above.

For a vertical cable of a wind tower, there exists a risk that in the warm or hot environment inside the tower, which makes the corrosion protective strand filler substance to be more liquid, the filler substance leaks, especially under dynamic movements of the cable. With the improved sealing properties of the anchorage according to the invention, there is a better prevention of corrosion protection product leakage at the bottom end of the wind tower. Also, as previously mentioned such an anchorage creates a better mechanical fixing between the bare strand and its sheath and between the strand and the channel portion equipped with the seal element 26.

According to an embodiment, said seal element 26 is elastically deformable to a compressed state, in which it has a radial outer dimension which is smaller than or equal to all diameters of the inner wall 29 of the channel 6 between said second channel end 1 and said seal element 26, and the sealing element 26 is arranged in a removable manner in the recessed region 27. This provision enable the corresponding strand to be reinstalled or inspected during maintenance or control operation through a method in which both the strand and the seal element can be replaced in a simple way, with a reliable relative position. Like the seal 26, the optional filler material can be replaced easily in the space 51, by injection from the remote end 1, after replacement of the seal 26.

REFERENCE NUMBERS USED ON THE FIGURES

1 Second (remote) end of the anchorage (remote from running part)
2 Body of the anchorage
3 First (proximal) end of the anchorage (exit end for running part)
4 Structure
5 Strand
5*a* Sheathed portion of the strand
5*b* Unsheathed portion of the strand
5*c* Sheath
5*d* Wires
5*e* Deformed sheath end with outwardly radially protrusion
D1 Outer diameter of the sheathed portion 5*a* (sheathed strand 5)
D2 Outer diameter of the unsheathed portion 5*b* (bare strand 5)
6 Anchorage channels
7 Principal longitudinal axis of the cable
8 Main running part of the cable
9 Stop element (bushing)
9' Stop element (narrowing of the channel 6)
9" Stop element (tube)
9*a* Shoulder
DT1 Outer diameter of the stop element
DT2 Inner diameter of the stop element
9*a* Shoulder
10 Adjustment ring or split shim
11 Anchor block
11*a* Enlarged portion of the hole
12 Conical wedges
13 Collar element
20 End plate
26 Seal element
DS1 Outer diameter of the seal element in its uncompressed state
DS2 Inner diameter of the seal element in its uncompressed state
LS Length of seal element its uncompressed state
LS' Length of seal element its compressed state
26' Compressed seal element
D1' Mean outer diameter D1' of the compressed seal element
27 Recessed region
27' Reduced space
LR Length of recessed region
DR Outer diameter of said recessed region
29 Inner wall
A1 Pulling length up to abutment (first pulling length)
A2 Pulling length up to deformation of the sheathed end 5*e* (second pulling length)
51 Space

The invention claimed is:

1. A cable anchorage comprising:

at least one axial channel for accommodating an elongated element with a sheathed portion and an unsheathed end portion, wherein the channel extends between a first channel end, proximal to a running part of the elongated element, and a second channel end equipped with immobilising device; and a seal element positionable along an inner wall of the channel so as to provide a seal between the inner wall of the channel and the elongated element, when the elongated element is in the channel, said seal element comprising an elastic material;

the inner wall of the channel comprises an annular or cylindrical recessed region, for accommodating the seal element so as to retain the seal element within said recessed region during an axial displacement of the elongated element in the channel, a stop element located in a region in said channel at a longitudinal location between said second channel end and said seal element, said stop element having a radial inner face forming a portion of the inner wall of the channel, wherein the inner diameter of the stop element is smaller than the outer diameter of the seal element in its uncompressed state, wherein said stop element has an end facing said seal element which defines a shoulder, and wherein said regions receiving said seal element and said stop element are longitudinally adjacent to each other in the channel so that, during said axial displacement of said elongated element, said seal element is able to be placed in a longitudinal location adjoining said stop element, with the seal element abutting the shoulder, and so that an axial displacement of the elongated element with respect to the stop element is possible up to the abutment of the end of the sheathed portion of the elongated element against the shoulder, creating thereby an abutment position of the elongated element in said axial channel;

wherein the volume of the recessed region is made such that in said abutment position the sheath end of the sheathed portion is deformed so as to form an outwardly radially protrusion at least partially surrounded by the seal element which is thereby outwardly radially compressed by said deformed sheath end, whereby said deformed sheath end is mechanically anchored inside the recessed region in said axial channel.

2. The cable anchorage according to claim 1, wherein the volume of said recessed region that contains the seal element is less than or equal to 3-times the volume of the displaced sheath during said axial displacement of said elongated element up to said abutment position plus the volume of said un-compressed seal element:

$$\Pi/4\times(LR)\times((DR)^2-(D2)^2)\leq 3\times(\Pi/4\times(A1\times((D1)^2-(D2)^2)+LS\times((DS1)^2-(DS2)^2)).$$

3. The cable anchorage according to claim 1, wherein said recessed region is longitudinally coaxial with said channel.

4. The cable anchorage according to claim 1, wherein said shoulder is formed by a narrowing of said channel at the location of said stop element.

5. The cable anchorage according to claim 1, wherein said stop element is formed by a bushing placed within said channel and wherein said shoulder is formed between the end face of the bushing facing said seal element and the channel.

6. The cable anchorage according to claim 5, wherein the outer diameter (DR) of said recessed region receiving said seal element is sensitively equal to the outer diameter (DT1) of the bushing.

7. The cable anchorage according to claim 1, wherein said stop element is formed by a tube placed within said channel, wherein said tube extends up to the immobilising device, and wherein said shoulder is formed between the end face of the tube facing said seal element and the channel.

8. The cable anchorage according to claim 1, wherein said seal element is elastically deformable to a compressed state, in which it has a radial outer dimension which is smaller than or equal to all diameters of the inner wall of the channel between said second channel end and said seal element, and the sealing element is arranged in a removable manner in the recessed region.

9. The cable anchorage according to claim 1, further comprising a plurality of axial channels, each channel for individually accommodating a strand of a cable with a sheathed portion and an unsheathed portion, and for each axial channel a seal element, an annular or cylindrical recessed region for accommodating the seal element and a stop element.

10. A prestressing system comprising at least one tendon forming said elongated element, said tendon having an unsheathed portion at its both ends, and two cable anchorages for the fixing under tension of the two end portions of said tendon, wherein at least one of said two cable anchorages is a cable anchorage according to claim 1.

11. The prestressing system according to claim 10, wherein said tendon comprises a bare strand placed in a sheath, wherein said sheath is adhering to the outer surface of the bare strand such as to limit the relative movement between said sheath and bare strand under thermal effects in the typical service temperature range of −20° C. to +40° C. to less than L/2000 with L being the length of the sheathed strand portion.

12. The prestressing system according to claim 10, wherein said tendon comprises a strand placed in a sheath, wherein said sheath has a minimum friction resistance against sliding on the bare strand of 1000N when determined on a 300 mm long sheathing sample in accordance with Standard XP A35-037-1 clause D3 (type SC).

13. A wind tower comprising a bottom part and a top part, and, between said bottom part and said top part, at least one prestressing system according to claim 11.

14. A method for installing and tensioning a sheathed elongated element with a sheathed running portion, a first unsheathed end portion and a second unsheathed end portion, said sheathed elongated element comprising a sheath with a first sheath end adjacent to said first unsheathed end portion and a second sheath end adjacent to said second unsheathed end portion, said method comprising the following steps:

providing for at least the second unsheathed end portion an axial channel extending between a first channel end, proximal to said running part of the elongated element, and a second channel end, said axial channel being equipped with a seal element and with a stop element placed between said seal element and said second channel end, both seal element and stop element defining a passage for the elongated element, wherein the inner diameter (DT2) of the stop element is smaller than the outer diameter (DS1) of the seal element in its uncompressed state, introducing, for at least the second unsheathed end portion, the extremity of said unsheathed end portion in said first channel end and axially displacing said extremity of said unsheathed end portion up to the second channel end, immobilising the extremity of said first unsheathed end portion with respect to a cable anchorage pulling the extremity of said second unsheathed end portion from the second channel end at least until the second sheath end of said sheath end portion abuts against a shoulder of said stop element in order to obtain a tensioned elongated element, creating thereby an abutment position of the elongated element in said axial channel, and immobilising the extremity of said second unsheathed end portion of said tensioned elongated element with respect to said second channel end, wherein said shoulder is defined at an end of said stop element which faces said seal element, wherein the regions receiving said seal element and said stop element are longitudinally adjacent to each other in the channel, so that, during said pulling step and the axial displacement of said elongated element, said seal element is able to be placed in a longitudinal location adjoining said stop element, with the seal element abutting the shoulder;

wherein the volume of the recessed region is made such that in said abutment position the sheath end of the sheathed portion is deformed so as to form an outwardly radially protrusion at least partially surrounded by the seal element which is thereby outwardly radially compressed by said deformed sheath end, whereby said deformed sheath end is mechanically anchored inside the recessed region in said axial channel.

* * * * *